US006621468B2

(12) United States Patent
Kanamaluru

(10) Patent No.: US 6,621,468 B2
(45) Date of Patent: Sep. 16, 2003

(54) LOW LOSS RF POWER DISTRIBUTION NETWORK

(75) Inventor: Sridhar Kanamaluru, West Windsor, NJ (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/817,431

(22) Filed: Mar. 26, 2001

(65) Prior Publication Data

US 2002/0135526 A1 Sep. 26, 2002

Related U.S. Application Data

(60) Provisional application No. 60/234,584, filed on Sep. 22, 2000.

(51) Int. Cl.[7] ..... H01Q 21/00

(52) U.S. Cl. ..... 343/853; 343/772; 343/776; 343/893; 343/700 MS

(58) Field of Search ..... 343/762, 772, 343/776, 777, 893, 850, 853, 778, 784, 700 MS; 333/137

(56) References Cited

U.S. PATENT DOCUMENTS

| | | | | |
|---|---|---|---|---|
| 758,457 A | | 10/1904 | Moore | |
| 3,969,729 A | | 7/1976 | Nemit | 343/756 |
| 4,905,012 A | | 2/1990 | Foti | 342/399 |
| 5,029,306 A | | 7/1991 | Bull et al. | 342/368 |
| 5,041,836 A | | 8/1991 | Paschen et al. | 342/375 |
| 5,162,803 A | | 11/1992 | Chen | 342/372 |
| 5,530,449 A | | 6/1996 | Wachs et al. | 342/174 |
| 5,543,805 A | * | 8/1996 | Thaniyavarn | 342/368 |
| 5,557,291 A | | 9/1996 | Chu et al. | 343/725 |
| 5,694,498 A | | 12/1997 | Manasson et al. | 385/15 |
| 5,796,881 A | | 8/1998 | Manasson et al. | 385/9 |
| 5,926,147 A | | 7/1999 | Sehm et al. | 343/776 |
| 5,930,031 A | | 7/1999 | Zhou et al. | 359/344 |
| 5,936,595 A | | 8/1999 | Wang | 343/895 |
| 5,977,910 A | | 11/1999 | Matthews | 342/368 |
| 5,977,911 A | | 11/1999 | Green et al. | 342/375 |
| 6,037,910 A | * | 3/2000 | Solbach et al. | 343/771 |
| 6,075,494 A | | 6/2000 | Milroy | 343/776 |
| 6,104,343 A | | 8/2000 | Brookner et al. | 342/372 |
| 6,411,174 B1 | * | 6/2002 | Crouch et al. | 333/125 |

FOREIGN PATENT DOCUMENTS

| | | | |
|---|---|---|---|
| WO | WO 00/28620 | 5/2000 | H01Q/13/28 |

OTHER PUBLICATIONS

PCT International Search Report, Int. App. No. PCT/US 01/29098, Jul. 5, 2002.

* cited by examiner

*Primary Examiner*—Don Wong
*Assistant Examiner*—Thuy Vinh Tran
(74) *Attorney, Agent, or Firm*—William J. Burke

(57) ABSTRACT

A radio frequency (RF) power distribution network includes a block assembly having integrated therein a network of waveguides and a plurality of waveguide power dividers. The block assembly has an input waveguide and N output waveguides. The waveguides and waveguide power dividers form a waveguide network for dividing the power of an RF signal present at the input waveguide among the N output waveguides. The RF distribution network can be adapted for use as a feed network for phased array antenna systems.

18 Claims, 3 Drawing Sheets

LOW LOSS RF POWER DISTRIBUTION NETWORK

CROSS-REFERENCE TO RELATED APPLICATIONS

This application claims benefit of U.S. provisional patent application serial No. 60/234,584, filed Sep. 22, 2000, which is herein incorporated by reference.

BACKGROUND OF THE INVENTION

1. Field of the Invention

The present invention generally relates to RF power distribution systems, and, more particularly, the invention relates to a low loss waveguide feed network for phased array antenna systems.

2. Description of the Related Art

Phased array antennas exhibit desirable properties for communications and radar systems, the most salient of which is the lack of any requirement for mechanically steering the transmitted or received beam. This feature allows for very rapid beam scanning and the ability to direct high power to a target from a transmitter, or receive from a target with a receiver, while minimizing typical microwave power losses. The basis for directivity control in a phased array antenna system is wave interference. By providing a large number of sources of radiation, such as a large number of equally spaced antenna elements fed from a combination of currents of designed phases, high directivity can be achieved. With multiple antenna elements configured as an array, it is therefore possible, with a fixed amount of power, to greatly reinforce radiation in a desired direction.

In order to obtain such directivity, phased array antennas require radio frequency (RF) power distribution systems (also known as feed networks). The feed network losses, the required gain, and the required beamwidth all affect the required antenna size. Current phased array antennas use a variety of RF power distribution networks, such as microstrip or stripline feed networks. Such networks, however, have relatively high losses and thereby increase the size of the antenna array for a given antenna gain.

Therefore, there exists a need in the art for a low loss RF power distribution network for small, low profile phased array antennas.

SUMMARY OF THE INVENTION

The disadvantages associated with the prior art are overcome by a waveguide feed network comprising a block assembly having integrated therein a network of waveguides and a plurality of waveguide power dividers. The block assembly includes an input waveguide and N output waveguides. The block assembly can be a split-block assembly formed of either metal or metallized plastic. The waveguides and waveguide power dividers form a waveguide network for dividing the power of a radio frequency (RF) signal present at the input waveguide among the N output waveguides. In one embodiment, the waveguide power dividers are "rat-race" couplers coupled together in a binary tree formation. The waveguide feed network can function as an N:1 power divider/combiner for use with phased array antenna systems.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
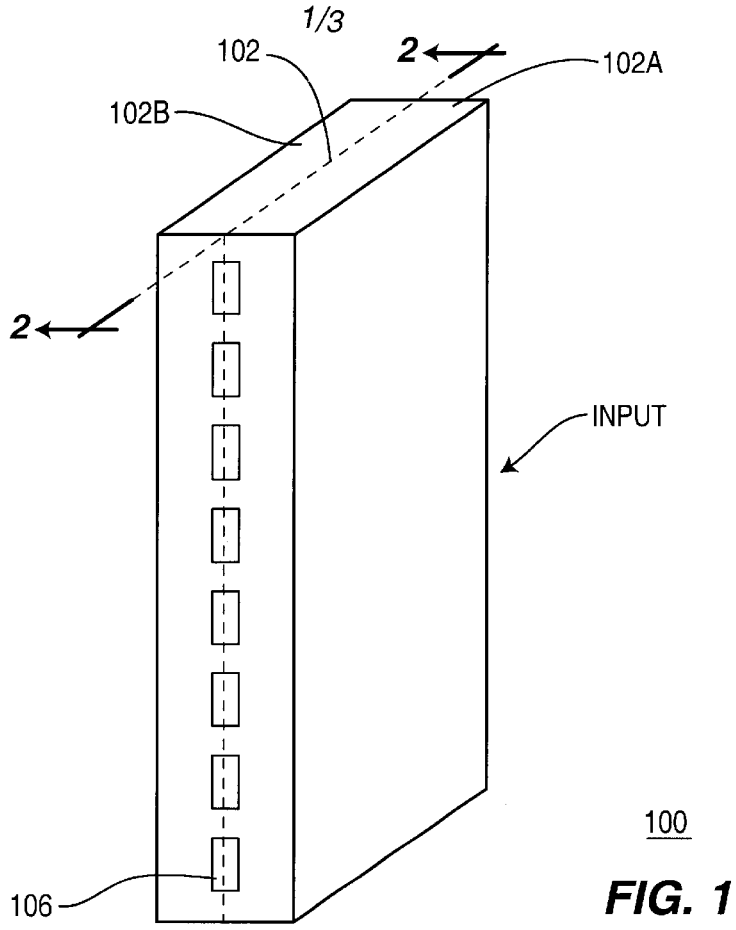
FIG. 1 depicts an isometric view of a waveguide feed network in accordance with the present invention.
Figure 2:
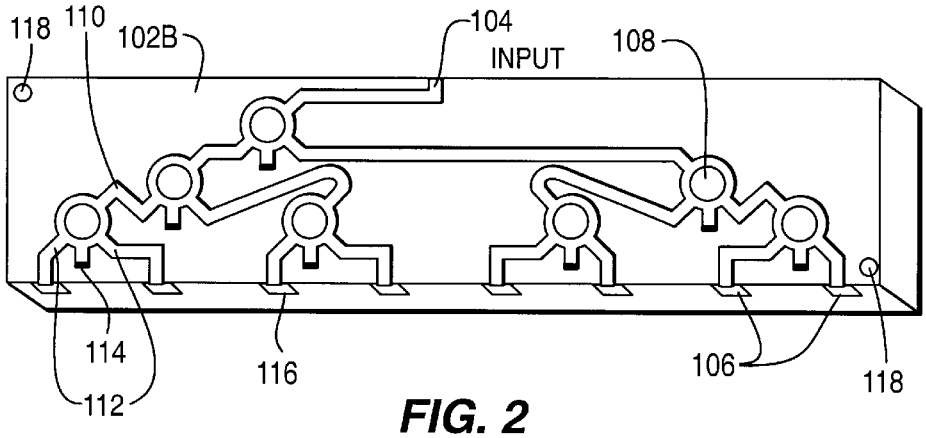
FIG. 2 depicts a cross-section of the waveguide feed network of FIG. 1, taken along the line 2—2 thereof, and looking in the direction of the arrows.

FIG. 1 depicts an isometric view of a waveguide feed network 100 in accordance with the present invention. FIG. 2 depicts a cross section of the waveguide feed network 100 of FIG. 1, taken along the line 2—2 thereof, and looking in the direction of the arrows. Referring to FIGS. 1 and 2, the waveguide feed network 100 comprises a block assembly 102 having formed therein an input waveguide 104, N output waveguides 106 (8 are shown), and a plurality of waveguide power dividers 108 (7 are shown). The block assembly 102 and the waveguide power dividers 108 form a waveguide network that divides the power of a radio frequency (RF) signal present at the input waveguide 104 among the plurality of output waveguides 106. Although the waveguide feed network 100 is described in the power division mode, it is understood by those skilled in the art that the present invention is useful for both power division and power combination.

More specifically, the block assembly 102 comprises a split-block assembly having two identical halves 102A and 102B. Each half 102A or 102B can be fabricated using a die-cast process for metal waveguides or a molding process for metallized plastic waveguides. The halves 102A and 102B are mechanically coupled using screws or like type fasteners and are aligned using pins 118 to form the waveguide network described above. The waveguides in the block assembly 102 are air-filled to provide a low loss network. In an alternative embodiment, the waveguides can be filled with a dielectric. Wide band operation is achieved using a non-dispersive medium, such as a ridge waveguide. Overall, the waveguide feed network of the present invention results in a very low cost feed network.

In one embodiment, the waveguide power dividers 108 are "rat-race" couplers. The rat-race coupler comprises an input port 110, two output ports 112, and an isolated port 114. As understood by those skilled in the art, the energy of an RF signal present at the input port 110 splits so that half travels in one direction around the rat-race coupler and the other half travels in the opposite direction. Half the energy appears at each output port 112, while the isolated port 114 receives little or no energy. In addition, the output signals of the rat-race coupler 108 are 180 degrees out-of-phase with each other, which results in one output being 90 degrees out-of-phase with the input and the other being 270 degrees out-of-phase with the input. The isolated port 114 of the rat-race coupler is terminated with a matched termination to prevent any spurious signals appearing at the output ports 112.

Each waveguide power divider 108 divides the power of an input RF signal among its two output ports 112 in a similar fashion. Power division from the input waveguide 104 to the output waveguides 106 is achieved using a binary tree structure of waveguide power dividers 108. That is, each output port 112 of a waveguide power divider 108 is coupled to the input port 110 of another waveguide power divider 108 until there is an output port 112 for each output waveguide 106. This structure results in N-1 power dividers 108 for N output waveguides 106. Although FIGS. 1 and 2 depict an 8:1 power divider, it is understood by those skilled in the art that the present invention can be extended to a N:1 power divider/combiner.

The present invention is useful for phased array systems where the power from a transmitter port is split and supplied to many radiating elements. In phased array systems, the power division may vary from port to port in both amplitude and phase. The present invention implements unequal power division by causing the output waveguides 106 to have different heights, such that they have different characteristic impedances. Thus, the present invention is useful for phased array systems that employ a tapered amplitude distribution (i.e., not equal power to all the ports). The present invention employs phase-shift devices 116 for varying the phase of the input signals to each radiating element of a phased array system.

Figure 3A:
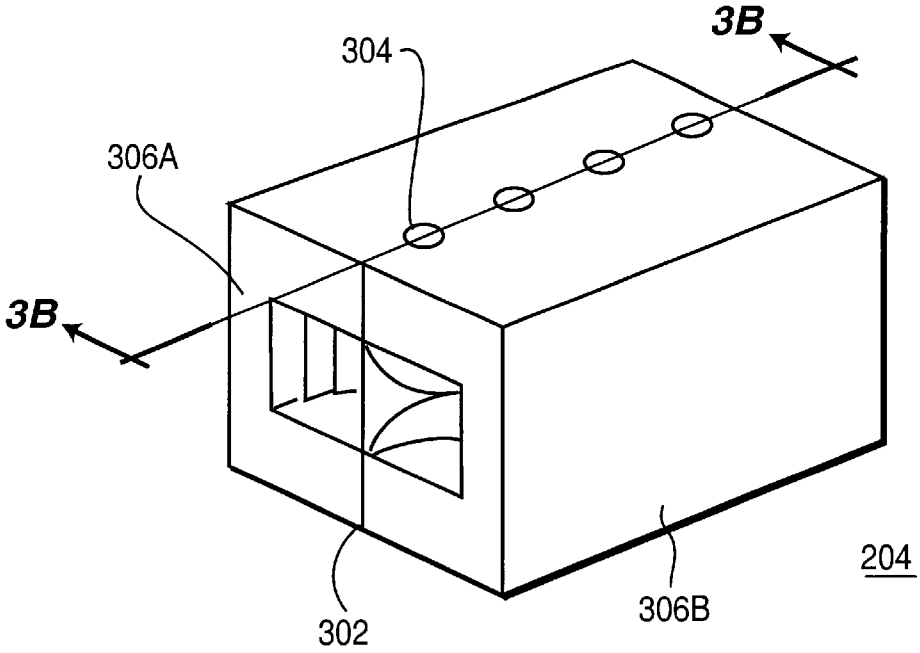
FIG. 3A depicts an isometric view of one embodiment of a phase-shift device.
Figure 3B:
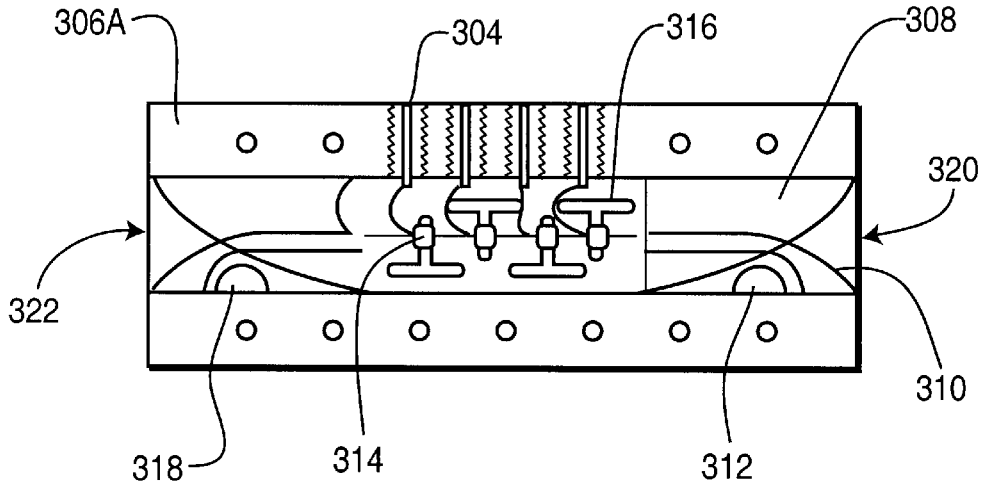
FIG. 3B depicts a cross-section of the phase-shift device of FIG. 3A, taken along the line 3B—3B thereof, and looking in the direction of the arrows.

FIG. 3A depicts an isometric view of one embodiment of a phase-shift device 116. FIG. 3B depicts a cross-section of the phase-shift device 116, taken along the line 3B—3B, looking in the direction of the arrows. Referring to FIGS. 3A and 3B, the phase-shift device 116 comprises a block 306 having first and second halves 306A and 306B, and a finline structure 302 disposed between the halves 306A and 306B. In the present embodiment, the finline structure 302 comprises a finline-to-microstrip transition 312, a microstrip line 310, a plurality of TTD differential line lengths 316, a plurality of RF switches 314, and a microstrip-to-finline transition 318. The TTD differential line lengths 316 and the RF switches are collectively known as a TTD circuit. The RF switches 314 can be diode, field effect transistor (FET), microelectromechanical (MEM), or like type switches. The RF switches 314 are controlled via control pins 304 that are accessible along the outside of the phase-shift device 116. Metallization 308 is disposed on the inside wall of each half 306A and 306B to provide a groundplane for the finline structure 302.

In operation, an input port 320 to the phase-shift device 116 receives RF energy from a waveguide. The RF energy is coupled to the finline-to-microstrip transition 312, which transitions the RF energy from the waveguide to the microstrip line 310. The microstrip line 310 couples the RF energy to the TTD differential line lengths 316. Phase variation is achieved, as is well known in the art, by causing the RF switches 314 to select particular TTD differential line lengths 316 using the control pins 304. After the appropriate phase-shift, the microstrip line 310 couples the RF energy to the microstrip-to-finline transistion 318, which transitions the RF energy from the microstrip line 310 back to a waveguide present at an output port 322 of the phase-shift device 116.

Figure 4:
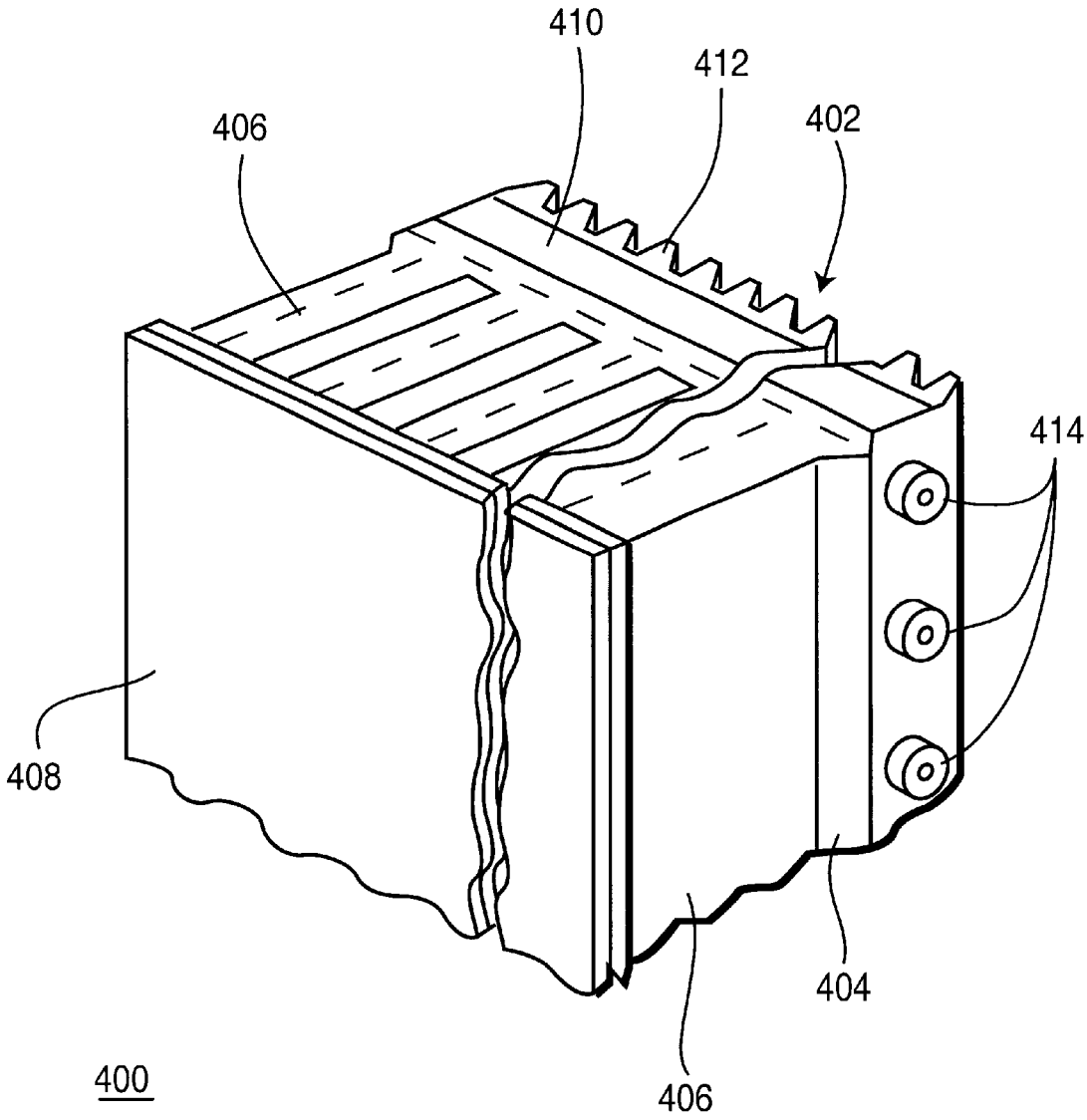
FIG. 4 depicts an isometric view of a phased array antenna system.

FIG. 4 depicts an isometric view of a phased array 400. The phased array 400 comprises a control device 402, a lateral waveguide feed network 404, N vertical waveguide feed networks 406, and a M×N planar array of radiating elements 408. The vertical waveguide feed networks 406 are M:1 power divider/combiners as described above. The lateral waveguide feed network 404 is a N:1 power divider/combiner as described above, but having a different aspect ratio. The aspect ratio of the lateral waveguide feed network 404 is such that each of the N output waveguides of the lateral feed network 404 are coupled to an input waveguide of one of the N vertical waveguide feed networks 406. The control device 402 comprises an adaptive processing device 410 for phase control, a heatsink 412, and a plurality of input ports (3 are shown) for connecting power and input RF signals. The radiating elements 408 are microstrip patch or like type antenna elements known in the art.

In operation, an RF signal to be transmitted is coupled to the input port of the lateral waveguide feed network 404. The lateral waveguide feed network 404 divides the power of the RF signal among its N outputs. Each output of the lateral waveguide feed network 404 is coupled to the input of a respective vertical waveguide feed network 406. Each vertical waveguide feed network 406 divides the power of the RF signal among its M outputs. In this manner, every radiating element 408 receives a replica of the RF signal for transmission. The adaptive processing device 410 controls the phase of the RF signals present at the outputs of the waveguide feed networks 304 and 306. Although the phased array 300 has been described in the transmission mode of operation, it is understood by those skilled in the art that the present invention is useful for both the transmission and receiving modes of operation.

While foregoing is directed to the preferred embodiment of the present invention, other and further embodiments of the invention may be devised without departing from the basic scope thereof, and the scope thereof is determined by the claims that follow.

What is claimed is:

1. A radio frequency (RF) power distribution network comprising:

a block assembly having a first half mechanically coupled to a second half, the first half and the second half forming an input waveguide and N output waveguides, where N is an integer greater than one; and a plurality of waveguide power dividers disposed within said block assembly for dividing the power of an RF signal present at said input waveguide among said N output waveguides.

2. The RF power distribution network of claim 1 wherein said first half and said second half are formed of metallized plastic.

3. The RE power distribution network of claim 1 wherein said first half and said second half are formed of metal.

4. The RF power distribution network of claim 1 wherein said plurality of waveguide power dividers comprise N–1 rat-race couplers coupled in a binary tree formation.

5. The RF power distribution network of claim 1 wherein each of said N output waveguides has a predetermined height for controlling the power of said RF signal.

6. The RF power distribution network of claim 1 wherein each of said N output waveguides is coupled to a phase-shift device.

7. The RF power distribution network of claim 6 wherein said phase-shift devices comprise:

a block having a first half and a second half; and a finline structure disposed between said first and second halves, said finline structure having a true time delay (TTD) circuit.

8. A phased array antenna system comprising:

an M×N array of antenna elements, where M and N are integers greater than one;

N vertical waveguide feed networks, each of said N vertical waveguide feed networks having an input and M output waveguides;

a lateral waveguide feed network having an input and N output waveguides; and a control device for adaptively varying the phase of the RF signal transmitted or received by each element in said array of elements;

wherein each of said M output waveguides of said N vertical waveguide feed networks is coupled to a respective one of said M×N army of elements; and each of said input waveguides of said N vertical waveguide feed networks is coupled to a respective one of said N output waveguides of said lateral waveguide feed network.

9. The phased array antenna system of claim 8 wherein each of said N vertical waveguide feed networks comprises:

a block assembly having formed therein said input waveguide and said M output waveguides; and a plurality of waveguide power dividers disposed within said block assembly for dividing the power of an RF signal present at said input waveguide among said M output waveguides.

10. The phased array antenna system of claim 9 wherein said block assembly comprises a first half and a second half.

11. The phased array antenna system of claim 10 wherein said first half and said second half are formed of metallized plastic.

12. The phased array antenna system of claim 10 wherein said first half and said second half are formed of metal.

13. The phased array antenna system of claim 9 wherein said plurality of waveguide power dividers comprise M−1 rat-race couplers coupled in a binary tree formation.

14. The phased array antenna system of claim 9 wherein each of said M output waveguides has a predetermined height for controlling the power of said RF signal.

15. The phased array antenna system of claim 9 wherein each of said M output waveguides is coupled to a phase-shift device.

16. The phased array antenna system of claim 15 wherein said phase-shift devices comprise:

a block having a first half and a second half; and a finline structure disposed between said first and second halves, said finline structure having a true time delay (TTD) circuit.

17. A radio frequency (RF) power distribution network comprising:

a block assembly having formed therein an input waveguide and N output waveguides, where N is an integer greater than one; and a plurality of waveguide power dividers disposed within said block assembly for dividing the power of an RF signal present at said input waveguide among said N output waveguides, wherein said plurality of waveguide power dividers comprises N−1 rat-race couplers coupled in a binary tree formation.

18. A radio frequency (RF) power distribution network comprising:

a block assembly having formed therein an input waveguide and N output waveguides, where N is an integer greater than one; and a plurality of waveguide power dividers disposed within said block assembly for dividing the power of an RF signal present at said input waveguide among said N output waveguides;

where each of said N output waveguides is coupled to a phase-shift device including:

a block having a first half and a second half; and a finline structure disposed between said first and second halves, said finline structure having a true time delay (TTD) circuit.

* * * * *